US005474617A

United States Patent [19]

Saito et al.

[11] Patent Number: 5,474,617

[45] Date of Patent: Dec. 12, 1995

[54] IMAGE HOLDING-SUPPORTING MEMBER AND REGENERATING METHOD THEREOF

[75] Inventors: Tadashi Saito; Kiyoshi Tanikawa, both of Yokohama; Toshiyuki Kawanishi, Numazu; Iwao Takahashi, Yokosuka, all of Japan

[73] Assignee: Ricoh Company, Ltd., Tokyo, Japan

[21] Appl. No.: 115,194

[22] Filed: Aug. 31, 1993

[30] Foreign Application Priority Data

| | | | |
|---|---|---|---|
| Aug. 31, 1992 | [JP] | Japan | 4-255915 |
| Aug. 31, 1992 | [JP] | Japan | 4-255916 |
| Apr. 27, 1993 | [JP] | Japan | 5-123344 |
| Jul. 23, 1993 | [JP] | Japan | 5-202557 |

[51] Int. Cl.[6] ..... B08B 1/02; G03G 21/00

[52] U.S. Cl. ..... 134/15; 134/39; 430/125; 15/102; 355/307

[58] Field of Search ..... 430/49, 125, 117; 134/15, 39; 355/307; 15/102, 77

[56] References Cited

U.S. PATENT DOCUMENTS

| | | | |
|---|---|---|---|
| 1,947,748 | 2/1934 | Van Wormer | 15/7 |
| 2,207,966 | 7/1940 | Billings et al. | 101/1 |
| 2,831,409 | 4/1958 | Bixby et al. | 95/1.7 |
| 2,937,390 | 5/1960 | Bolton et al. | 15/3 |
| 3,108,895 | 10/1963 | Howell | 117/19 |
| 3,237,231 | 3/1966 | Zink | 15/102 |
| 3,328,821 | 7/1967 | LaMura | 15/102 |
| 3,598,487 | 10/1971 | Mizuguchi | 355/15 |
| 3,613,701 | 10/1971 | Ando | 134/64 |
| 3,630,776 | 12/1971 | Barr | 430/125 |
| 3,656,948 | 4/1972 | Mammino | 96/1.4 |
| 3,776,631 | 12/1973 | Mammino | 355/15 |
| 4,252,882 | 2/1981 | Herrmann | 430/125 |
| 4,388,391 | 6/1983 | Schell | 430/125 |
| 4,392,742 | 7/1983 | Landa | 355/15 |
| 4,482,241 | 11/1984 | Moraw et al. | 355/10 |
| 4,504,995 | 3/1985 | Zippwald | 15/102 |
| 4,733,422 | 3/1988 | Schramm et al. | 15/77 |
| 4,740,075 | 4/1988 | Schoernig | 354/320 |
| 4,800,839 | 1/1989 | Ariyama et al. | 118/691 |
| 4,905,047 | 2/1990 | Ariyama | 355/256 |
| 5,215,852 | 6/1993 | Kato et al. | 430/126 |
| 5,262,259 | 11/1993 | Chou et al. | 430/47 |

FOREIGN PATENT DOCUMENTS

| | | | |
|---|---|---|---|
| 5056942 | 5/1975 | Japan | G03G 21/00 |
| 51-100728 | 9/1976 | Japan | G03G 21/00 |
| 5427435 | 3/1979 | Japan | G03G 5/00 |
| 54-99353 | 8/1979 | Japan | B08B 1/04 |
| 57-114171 | 7/1982 | Japan | G03G 21/00 |
| 57-125962 | 8/1982 | Japan | G03G 21/00 |
| 57-125963 | 8/1982 | Japan | G03G 21/00 |
| 58-105569 | 7/1983 | Japan | G03G 21/00 |
| 59-2069 | 1/1984 | Japan | G03G 21/00 |
| 59-33483 | 3/1984 | Japan | G03G 21/00 |
| 59-89372 | 5/1984 | Japan | C09D 9/00 |
| 59-93764 | 5/1984 | Japan | C09D 9/00 |

(List continued on next page.)

*Primary Examiner*—John Goodrow
*Attorney, Agent, or Firm*—Cooper & Dunham

[57] ABSTRACT

A method for regenerating an image holding-supporting member has the steps of impregnating the image holding-supporting member with a liquid including at least water molecules; the image holding-supporting member having a chartaceous material constructed by cellulose as a principal component and having a hydrophobic image formed on this chartaceous material; and separating the hydrophobic image from the chartaceous material by an image separator in an impregnating state of the liquid so that an image can be recopied and reprinted on the chartaceous material. In accordance with this reproducing method, a copy is made or a sheet of printing paper is regenerated by cleanings of a PPC copying image and a PPC printing image normally utilized in markets at present in addition to cleaning of images copied and printed on sheets of special paper such as erasable paper so that the image holding-supporting member can be reused as a paper sheet for copying or printing. Another reproducing method and another image holding-supporting member are also shown. An apparatus for reproducing the image holding-supporting member is further shown.

21 Claims, 1 Drawing Sheet

FOREIGN PATENT DOCUMENTS

| | | | |
|---|---|---|---|
| 59-98172 | 6/1984 | Japan | G09D 9/00 |
| 60-133458 | 7/1985 | Japan | G03G 7/00 |
| 60-230899 | 11/1985 | Japan | B44C 1/16 |
| 62-102270 | 5/1987 | Japan | G03G 21/00 |
| 62-203190 | 9/1987 | Japan | G09F 3/02 |
| 62-212187 | 9/1987 | Japan | B41M 3/12 |
| 62-199767 | 12/1987 | Japan | G03G 21/00 |
| 63-73282 | 4/1988 | Japan | G03G 21/00 |
| 63-140577 | 9/1988 | Japan | G03G 21/00 |
| 1137266 | 5/1989 | Japan | G03G 9/08 |
| 1297294 | 11/1989 | Japan | B41N 3/00 |
| 211400 | 1/1990 | Japan | B44C 1/175 |
| 23400 | 1/1990 | Japan | B44C 1/175 |
| 255195 | 2/1990 | Japan | B41M 5/40 |
| 262277 | 3/1990 | Japan | B41M 1/14 |
| 2111987 | 4/1990 | Japan | G03G 21/00 |
| 2117547 | 9/1990 | Japan | G03G 7/00 |
| 2227299 | 9/1990 | Japan | B43L 19/00 |
| 3249661 | 11/1991 | Japan | G03G 7/00 |
| 422968 | 1/1992 | Japan | G03G 7/00 |
| 457070 | 2/1992 | Japan | G03G 15/01 |
| 464473 | 2/1992 | Japan | B41J 29/36 |
| 464472 | 2/1992 | Japan | B41J 29/36 |
| 491298 | 3/1992 | Japan | D21H 25/00 |
| 4-67043 | 3/1992 | Japan | G03G 7/00 |
| 482983 | 3/1992 | Japan | D21B 1/02 |
| 489271 | 3/1992 | Japan | B41J 29/36 |
| 4234056 | 4/1992 | Japan | G03G 15/00 |
| 4300395 | 10/1992 | Japan | D21H 25/00 |
| 4281096 | 10/1992 | Japan | D21H 25/00 |
| 4118500 | 10/1992 | Japan | D21H 25/00 |
| 4118499 | 10/1992 | Japan | D21H 25/00 |
| 4327299 | 11/1992 | Japan | D21H 25/00 |
| 4333699 | 11/1992 | Japan | D21H 25/00 |
| 4333088 | 11/1992 | Japan | G03G 21/00 |
| 4356085 | 12/1992 | Japan | G03G 21/00 |
| 4356089 | 12/1992 | Japan | G03G 21/00 |
| 4356086 | 12/1992 | Japan | G03G 21/00 |
| 4356088 | 12/1992 | Japan | G03G 21/00 |
| 4356087 | 12/1992 | Japan | G03G 21/00 |
| 52356 | 1/1993 | Japan | G03G 21/00 |
| 561382 | 3/1993 | Japan | G03G 21/00 |
| 562382 | 3/1993 | Japan | G11B 21/08 |
| 1101576 | 4/1993 | Japan | G03G 21/00 |
| 1101577 | 4/1993 | Japan | G03G 21/00 |
| 5127571 | 5/1993 | Japan | G03G 21/00 |
| 5216376 | 8/1993 | Japan | G03G 21/00 |
| 5216374 | 8/1993 | Japan | G03G 21/00 |
| 8903728 | 5/1989 | WIPO | B08B 1/02 |

Figure
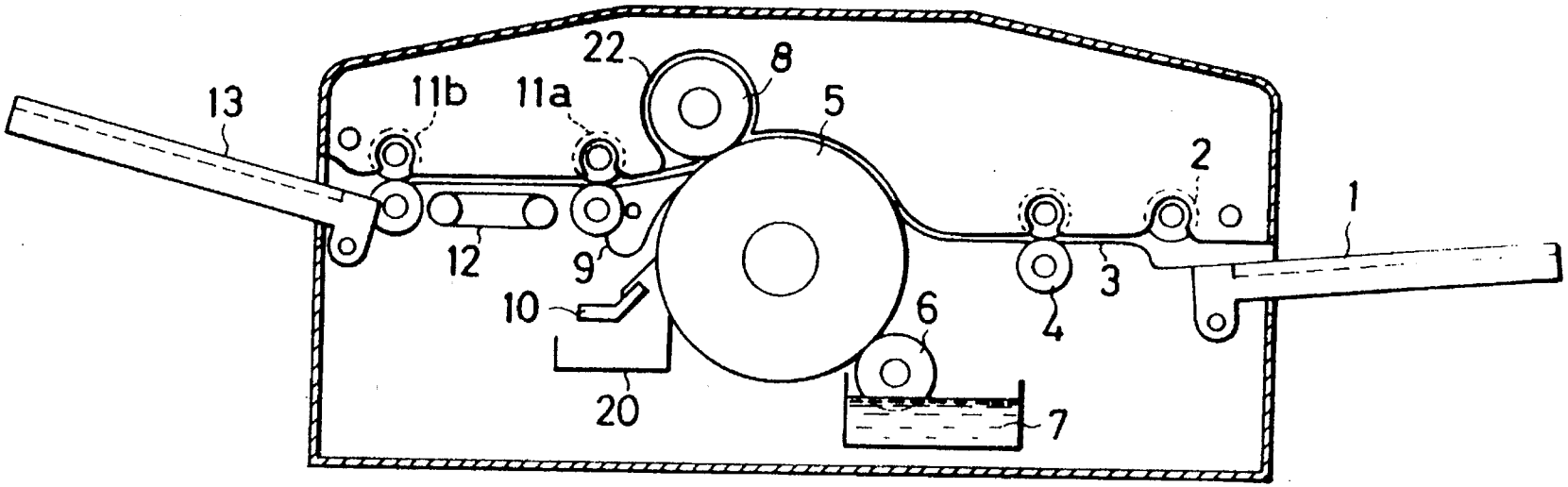

IMAGE HOLDING-SUPPORTING MEMBER AND REGENERATING METHOD THEREOF

BACKGROUND OF THE INVENTION

1. Field of the Invention

The present invention relates to an image holding-supporting member forming an image of thermally flexible toner or ink on a paper layer, and a method for regenerating the image holding-supporting member. More particularly, the present invention relates to a regenerated image supporting member such as a sheet of image supporting paper able to be regenerated and reused from the image holding-supporting member, and a method for regenerating the image supporting member.

2. Description of the Related Art

A large amount of printer paper sheets and copying paper sheets has recently been used by office automation (OA). Therefore, a problem about a change for the worse of earth environment is caused by deforestation. This problem is generally solved by only one method. In this method, toner, ink, etc. are removed from a sheet of paper once used, and the paper sheet is crushed in water. This water is removed from the paper sheet by filtration so that the paper sheet is regenerated as a so-called sheet of used paper. However, a new sheet of paper reusable for making a copy or printing is recently developed. This new paper sheet is reused by removing character images from a paper sheet once used by cleaning.

For example, Japanese Patent Application Laying Open (KOKAI) No. 4-67043 shows such a paper sheet. In this publication, mold-releasing processing is performed with respect to a surface of a sheetlike supporting member, especially, only one face of this sheetlike supporting member. This supporting member as a sheet of copying paper is then marked to discriminate the supporting member from plain paper.

However, such copying paper has the following disadvantages.

(1) This sheet of copying paper is a special sheet of paper having a surface obtained by mold-releasing processing and is not each of sheets of general copying paper and printing paper used so much at present. Therefore, it is difficult to use this surface-processed copying paper as each of the general copying and printing papers.

(2) Accordingly, it is difficult to make a copy by mixing the sheet of surface-processed paper with a sheet of general copying paper.

(3) It is important to make a double-sided copy in view of reuse of resources. Namely, it is important to make a copy on each of front and rear faces of one sheet of copying paper in view of reuse of resources. It is considered that the double-sided copy will become a main current in the future. In such a situation, it is difficult to utilize a sheet of regenerative paper coated with a mold-releasing agent on one face thereof.

(4) An image is formed on the mold-releasing agent so that no image is reliably fixed onto the paper sheet. Accordingly, it is difficult to use the paper sheet.

Japanese Patent Application Laying Open (KOKAI) Nos. 1-101576 and 1-101577 will next be described.

In each of these publications, an image supporting member forming an image thereon is dipped into an organic solvent for dissolving toner resin for forming the image on this image supporting member. The image is removed from the image supporting member by ultrasonic processing.

However, in this method, problems about environmental pollution, firing, toxicity, etc. are caused by using the organic solvent. Accordingly, it is difficult to use this image supporting member in general offices, homes, etc.

Japanese Patent Application Laying Open (KOKAI) No. 1-297294 will next be described.

This publication shows a method for cleaning an image forming supporting member. In this cleaning method, the image forming supporting member is formed by plastic, a metal, a sheet of paper or ceramic having low permeability with respect to liquid, etc. An image is formed on the image forming supporting member. This image is heated through a separating material thermally melted so that the image is removed from the image forming supporting member. However, in this cleaning method, it is necessary to use a sheet of special erasable paper having a surface on which mold-releasing processing is performed. Accordingly, such an image forming supporting member cannot be used as sheets of general copying and printing papers used so much at present.

SUMMARY OF THE INVENTION

It is therefore an object of the present invention to provide an image holding-supporting member such as a sheet of regenerative paper and sheets of regenerable copying and printing papers in which a copy is made or a sheet of printing paper is regenerated by cleanings of a PPC (plain paper copier) copying image and a PPC printing image normally utilized in markets at present in addition to cleaning of images copied and printed on sheets of special paper such as erasable paper so that the image holding-supporting member can be reused as a paper sheet for copying or printing.

In accordance with a first structure of the present invention, the above object can be achieved by a method for regenerating an image holding-supporting member, comprising the steps of impregnating the image holding-supporting member with a liquid including at least water molecules; the image holding-supporting member having a chartaceous material constructed by cellulose as a principal component in at least one portion of the image holding-supporting member and having a hydrophobic image formed on this chartaceous material; and separating the hydrophobic image from the chartaceous material by image separating means in an impregnating state of the liquid so that an image can be recopied and reprinted on the chartaceous material.

In accordance with a second structure of the present invention, the above object can be also achieved by a method for regenerating an image holding-supporting member, comprising the steps of making a liquid including at least water molecules and a surfactant; impregnating the image holding-supporting member with the liquid; the image holding-supporting member having a chartaceous material constructed by cellulose as a principal component in at least one portion of the image holding-supporting member and having a hydrophobic image formed on this chartaceous material; and separating the hydrophobic image from the chartaceous material by image separating means in an impregnating state of the liquid so that an image can be recopied and reprinted on the chartaceous material.

In accordance with a fourth structure of the present invention, the above object can be also achieved by a method for regenerating an image holding-supporting member, comprising the steps of making a liquid including at least water molecules include a water-soluble polymer;

impregnating the image holding-supporting member with the liquid; the image holding-supporting member having a chartaceous material constructed by cellulose as a principal component in at least one portion of the image holding-supporting member and having a hydrophobic image formed on this chartaceous material; and separating the hydrophobic image from the chartaceous material by image separating means in an impregnating state of the liquid so that an image can be recopied and reprinted on the chartaceous material.

In accordance with a sixth structure of the present invention, the above object can be also achieved by a method for regenerating an image holding-supporting member, comprising the steps of making a liquid including at least water molecules and a surfactant and a water-soluble polymer; impregnating the image holding-supporting member with the liquid; the image holding-supporting member having a chartaceous material constructed by cellulose as a principal component in at least one portion of the image holding-supporting member and having a hydrophobic image formed on this chartaceous material; and separating the hydrophobic image from the chartaceous material by image separating means in an impregnating state of the liquid so that an image can be recopied and reprinted on the chartaceous material.

In accordance with a ninth structure of the present invention, the above object can be also achieved by an image holding-supporting member comprising a chartaceous material constructed by cellulose as a principal component in at least one portion of the,image holding-supporting member; and a hydrophobic image formed on this chartaceous material; the image holding-supporting member being impregnated with a solution including at least water molecules and a surfactant.

In accordance with an eleventh structure of the present invention, the above object can be also achieved by an image holding-supporting member comprising a chartaceous material constructed by cellulose as a principal component in at least one portion of the image holding-supporting member; and a hydrophobic image formed on this chartaceous material; the image holding-supporting member being impregnated with a solution including at least water molecules and a water-soluble polymer.

In accordance with a thirteenth structure of the present invention, the above object can be also achieved by an image holding-supporting member comprising a chartaceous material constructed by cellulose as a principal component in at least one portion of the image holding-supporting member; and a hydrophobic image Formed on this chartaceous material: the image holding-supporting member being impregnated with a solution including at least water molecules, a surfactant and a water-soluble polymer.

In accordance with a sixteenth structure of the present invention, the above object can be also achieved by an apparatus for regenerating an image holding-supporting member, the image holding-supporting member including a chartaceous material constructed by cellulose as a principal component in at least one portion of the image holding-supporting member; and a hydrophobic image formed on this chartaceous material; the regenerating apparatus comprising means for coating the image holding-supporting member with liquid including at least water molecules; means for separating the hydrophobic image from the chartaceous material; and means for drying an image supporting member in which the hydrophobic image is separated from the chartaceous material.

In the above structures of the present invention, a copy is made or a sheet of printing paper is regenerated by cleanings of a PPC copying image and a PPC printing image normally utilized in markets at present in addition to cleaning of images copied and printed on sheets of special paper such as erasable paper so that the image holding-supporting member can be reused as a paper sheet for copying or printing.

Further objects and advantages of the present invention will be apparent from the following description of the preferred embodiments of the present invention as illustrated in the accompanying drawings.

BRIEF DESCRIPTION OF THE DRAWINGS

A sole FIGURE is a view for explaining an apparatus for regenerating an image holding-supporting member in accordance with one embodiment of the present invention.

DESCRIPTION OF THE PREFERRED EMBODIMENTS

The preferred embodiments of an image holding-supporting member and a regenerating method thereof in the present invention will next be described in detail with :reference to the accompanying drawings.

The present invention resides in an image holding-supporting member which has a chartaceous material constructed by cellulose as a principal component in at least one portion of the image holding-supporting member and has a hydrophobic image formed on this chartaceous material. The hydrophobic image is formed by thermally flexible ink or toner. The image holding-supporting member is impregnated with at least one kind of separating liquid or aqueous solution including water molecules. The separating liquid or aqueous solution is selected from a group of a liquid including water molecules, an aqueous solution including a surfactant, an aqueous solution including a water-soluble polymer, and an aqueous solution including a water-soluble polymer and a surfactant. The hydrophobic image is separated from the chartaceous material in a state in which the image holding-supporting member is impregnated with the separating liquid or aqueous solution, thereby regenerating the chartaceous material as an image supporting member.

The present invention also resides in an image holding-supporting member which has a chartaceous material constructed by cellulose as a principal component in at least one portion of the image holding-supporting member and has a hydrophobic image able to be formed on this chartaceous material. The hydrophobic image can be formed on the chartaceous material as an image supporting member by thermally flexible ink or toner. The image holding-supporting member is impregnated with at least one kind of aqueous solution. This aqueous solution is selected from a group of an aqueous solution including a surfactant, an aqueous solution including a water-soluble polymer, and an aqueous solution including a water-soluble polymer and a surfactant. Thereafter, the image holding-supporting member is dried to regenerate the chartaceous material as the image supporting member.

The present invention also resides in a method for regenerating an image holding-supporting member which has a chartaceous material constructed by cellulose as a principal component in at least one portion of the image holding-supporting member and has a hydrophobic image formed on this chartaceous material. The hydrophobic image is formed on the chartaceous material as an image supporting member by thermally flexible ink or toner. The image holding-supporting member is impregnated with at least one kind of separating liquid or aqueous solution including water molecules. The separating liquid or aqueous solution is selected from a group of a liquid including water molecules, an aqueous solution including a surfactant, an aqueous solution including a water-soluble polymer, and an aqueous solution including a water-soluble polymer and a surfactant. An image separating member is heated or pressurized and is adhered to the image holding-supporting member in a state in which the image holding-supporting member is impregnated with the separating liquid or aqueous solution. Thus, the hydrophobic image is separated from the chartaceous material, thereby regenerating the chartaceous material.

The present invention also resides in an apparatus for regenerating an image holding-supporting member which has a chartaceous material constructed by cellulose as a principal component in at least one portion of the image holding-supporting member and has a hydrophobic image formed on this chartaceous material. The hydrophobic image is formed on the chartaceous material as an image supporting member by thermally flexible ink or toner. The above regenerating method can be executed by this regenerating apparatus. The regenerating apparatus comprises means for coating the image holding-supporting member with at least one kind of separating liquid or aqueous solution including water molecules; the separating liquid or aqueous solution being selected from a group of a liquid including at least water molecules, an aqueous solution including a surfactant, an aqueous solution including a water-soluble polymer, and an aqueous solution including a water-soluble polymer and a surfactant; means for separating the hydrophobic image from the chartaceous material; and means for drying the image supporting member in which the hydrophobic image is separated from the chartaceous material.

The image supporting member in the present invention is mainly constructed by a sheet of copying or printing paper, but is not limited to such a paper sheet. For example, a supporting member holding an image thereon may be used. Further, the image supporting member is not necessarily constructed by the chartaceous material. It is sufficient to construct a paper layer for holding the hydrophobic image of thermally flexible toner or ink as a chartaceous material constructed by cellulose as a principal component. For example, the image supporting member may be constructed by a laminated material of a paper layer and a plastic layer laminated with each other.

The present invention is characterized in that only an image is removed from the chartaceous material in a state in which the image holding-supporting member is impregnated with a liquid or aqueous solution including water molecules, thereby regenerating and reutilizing the image supporting member as it is.

When paper is impregnated with an aqueous solution, this paper generally tends to be flexed. At this time, adhesive force between the paper layer and the hydrophobic image of thermally flexible toner or ink held on the paper layer is very reduced.

Namely, a surface of the chartaceous material constructed by cellulose fibers as a principal component is innumerably irregular since these fibers are entwined with each other. Further, small clearances are also innumerably formed inside the chartaceous material. When a hydrophobic image is formed on the chartaceous material in such a state, an image of thermally flexible toner fixed in a PPC copying process has a size larger than that of each of the small clearances and the irregularities caused by the cellulose fibers entwined with each other. Therefore, many small spaces are formed in a contact portion of the cellulose fibers and the hydrophobic image.

The image holding-supporting member having such a hydrophobic image is impregnated with the above separating liquid by the above coating means using coating, dipping, spraying, etc. Thus, the separating liquid such as a liquid, an aqueous solution, etc. constructed by water molecules as a principal component permeates the cellulose fibers and their clearances and spatial portions by a capillary phenomenon. Thus, the separating liquid permeates the cellulose fibers until a contact portion of the thermally flexible toner image and the cellulose fibers.

As a result, adhesive force of the thermally flexible toner image and the cellulose fibers is reduced and the cellulose fibers absorb the separating liquid. Thus, the cellulose fibers are deformed by a so-called swelling phenomenon. Accordingly, a space for the contact portion between the cellulose fibers and the thermally flexible toner image is increased so that an area for the contact of the cellulose fibers and the thermally flexible toner image is reduced. Therefore, adhesive force between the cellulose fibers and the thermally flexible toner image is reduced.

Accordingly, the image can be easily removed from the paper layer without damaging the paper layer by using a suitable separating means.

The above coating means impregnates the holding-supporting member of a hydrophobic image and/or an image supporting member capable of carrying the hydrophobic image with the above separating liquid by coating, dipping, spraying, etc. The concentration of a surfactant included in the separating liquid is preferably ranged from 0.01% to 20%. The concentration of a surfactant included in the image supporting member capable of carrying the hydrophobic image is also preferably ranged from 0.01% to 20%. In contrast to this, the concentration of a water-soluble polymer included in the separating liquid is preferably ranged from 0.1% to 20%. The concentration of a water-soluble polymer included in the image supporting member capable of carrying the hydrophobic image is also preferably ranged from 0.1% to 20%.

The above separating means makes an adhesive image separating member adhesively come in press contact with the hydrophobic image on the image supporting member when the hydrophobic image is heated or pressurized. Thus, the separating means separates the image from the image holding member as the chartaceous material by transferring the image onto the: image separating member. The image separating member is constructed by an organic high molecular (or polymer) material having an solubilty parameter-value (SP-value) similar to that of a substance constituting this image, a metallic material having high surface active energy, an evaporation film material for this metallic material, an inorganic material such as a ceramic material, etc., a material having irregular and porous surfaces, etc. The image separating member is preferably formed by each of such materials in the shape of each of a sheet, a belt, a roller, etc. such that the image separating member can be repeatedly used.

For example, component resin of the thermally flexible ink or toner removed from the chartaceous material in the present invention is constructed by polystyrene, acrylic resin, methacrylic resin, styrene-bytylacrylic copolymer, styrene-butadiene copolymer, polyester, epoxy resin, etc.

Wettability of a paper sheet holding the image of thermally flexible toner or ink with respect to water is important to sufficiently impregnate the image holding paper sheet with water for a short time. Further, water must sufficiently permeate a boundary of the image holding paper sheet and the thermally flexible toner or ink so as to remove the image from the image holding paper sheet.

A surfactant acts as a surface active agent for promoting a capillary phenomenon and rapidly impregnating the image holding paper sheet holding the hydrophobic image of thermally flexible toner or ink with the above separating liquid. Molecules of the surfactant are generally constructed by a combination of a lipophilic group and a hydrophilic group. The following Tables 1 and 2 respectively show examples of the lipophilic and hydrophilic groups in accordance with Applied Chemistry Editing of Chemical Handbook in Japan (1986), but the present invention is not limited to these examples.

Many kinds of surfactants are disclosed. The surfactants are generally composed of anionic surfactants of fatty acid derivative, sulfate, sulfonic acid and phosphate types, etc., cationic surfactants of quaternary ammonium salt, ester bonding amine, quaternary ammonium salt having ether linkage, heterocyclic amine, amine derivative, etc., an amphoteric surfactant, a nonionic surfactant, etc. The following Tables 3 to 7 show these typical surfactants, but the present invention is not limited to these surfactants.

TABLE

| Kinds of lipophilic group |
|---|
| Hydrocarbon (composed of carbon chains 6 to 22 in many cases)<br>n-alkyl, branching chain alkyl, substitutional alkyl, aromatic, plural chain alkyl and polyoxyalkylene<br>Partial fluorination alkyl and perfect fluorination alkyl<br>Polysiloxane class |

TABLE 2

| Kinds of hydrophilic group |
|---|
| Anionic kind |
| carboxylate, sulfonate, sulfate, phosphate and phosphonate |
| Cationic kind |
| amine salt, quaternary ammonium salt, pyridinium salt, sulfonium salt, phosphonium salt and polyethylene-polyamine |
| Amphoteric kind |
| amino acid, betaine, amino sulfate and sulfobetaine |
| Nonionic kind |
| Polyhydric alcohol (glycerol, glucose, sorbitol, cane sugar), amino alcohol, polyethylene glycol, semipolar bond (amine oxide, sulfoxide, amine imide) |

TABLE 3

- anionic surfactant
  - I. carboxylate
    - soap $RCOO^-$
    - N-acyl amino acid salt $RCON-COO^-$
    - alkyl ether carboxylate $RO(C_2H_4O)_nCOO^-$
    - acylation peptide $RCON-COO^-$
  - II. sulfonate
    - alkyl sulfonate $RSO_3^-$
    - alkylbenzene sulfonate and alkylnaphthalene sulfonate

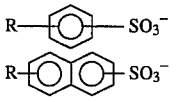

- sulfo succinic acid salt $R-OCOCH_2CH(SO_3^-)COOR$
    - α-olefin sulfonate
    - N-acyl sulfonate $-CON-SO_3^-$
  - III. sulfate
    - sulfated oil
    - alkyl sulfate $ROSO_3^-$
    - alkyl ether sulfate $R-O(C_2H_4O)_nSO_3^-$
    - alkyl allyl ether sulfate

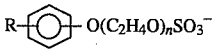

- alkyl amide sulfate $RCONH-OSO_3^-$
  - IV. phophate
    - alkyl phosphate

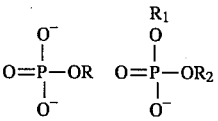

- alkyl ether phosphate

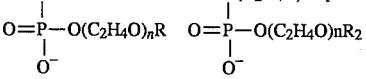

- alkyl allyl ether phosphate

TABLE 4

| Cationic surfactant |
|---|
| 1) Aliphatic amine salt and quaternary ammonium salt thereof |
| 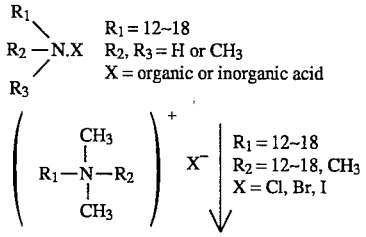 $R_1 = 12\sim18$; $R_2, R_3 = H$ or $CH_3$; X = organic or inorganic acid |
| 2) Aromatic quaternary ammonium salt |
| 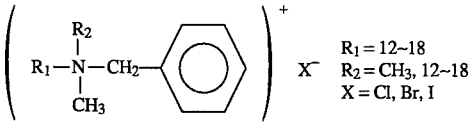 $R_1 = 12\sim18$; $R_2 = CH_3, 12\sim18$; X = Cl, Br, I |
| benzal conium salt<br>benzethonium chloride |
| 3) Heterocyclic quaternary ammonium salt |
| 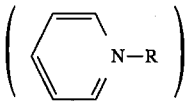 R = 12~18; X = Cl, Br, I |
| 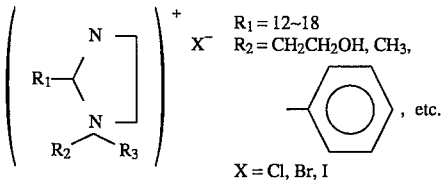 $R_1 = 12\sim18$; $R_2 = CH_2CH_2OH, CH_3$, etc.; X = Cl, Br, I |
| pyridinium salt<br>imidazolinium salt |

TABLE 5

| Amphoteric surfactant |
|---|
| A. Betaine |
| 1. carboxybetaine |
| 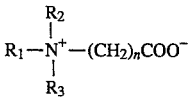 |
| ($R_1 = C_{12}\sim C_{18}$; $R_2, R_3$: $CH_3$, etc.; n = 1~Z) |
| 2. sulfobetaine |
| 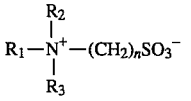 |
| ($R_1 = C_{12}\sim C_{18}$; $R_2, R_3$: $CH_3$, etc.; n = 1~Z) |
| B. Aminocarboxylate |
| $R-\overset{+}{N}H_2-(CH_2)_nCOO^-$ |
| ($R = C_{12}\sim C_{18}$; n = 1~Z) |
| C. Imidazoline derivative |
| 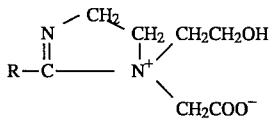 ($R = C_{12}\sim C_{18}$) |

TABLE 6

| Nonionic surfactant |
|---|
| I. Ether type |
| alkyl and alkyl allyl polyoxy ethylene ether |
| alkyl allyl formaldehyde condensation polyoxy ethylene ether |
| block polymer having polyoxy propylene as lipophilic group |
| polyoxy ethylene-polyoxy propyl alkyl ether |
| II. Ether ester type |
| polyoxy ethylene ether of glycerol ester |
| polyoxy ethylene ether of sorbitan ester |
| polyoxy ethylene ether of sorbitol ester |
| III. Ester type |
| polyethylene glycol-fatty acid ester |
| glycerol ester |
| polyglycerol ester |
| sorbitan ester |
| propylene glycol ester |
| cane sugar ester |
| IV. Nitrogen-including type |
| fatty acid alkanol amide |
| polyoxy ethylene-fatty acid amide |
| Polyoxy ethylene-alkyl amine |
| amine oxide |

TABLE 7

| Fluorine surfactant |
|---|
| Similar to normal surfactants, there are the following four kinds of fluorine surfactants.<br>(1) anionic type<br>(2) nonionic type<br>(3) cationic type<br>(4) amphoteric type |
| Typical fluorine surfactants |
| product names |
| fluoroalkyl($C_2$–$C_{10}$)carboxylate |
| N-perfluorooctane sulfonyl disodium glutamate |
| 3-[fluoroalkyl($C_6$–$C_{11}$)oxy]-1-alkyl($C_3$–$C_4$)sodium sulfonate |
| 3-[ω-fluoroalkanoyl($C_6$–$C_8$)-N-ethyl amino]-1-propane sodium sulfonate |
| N-[3-(perfluorooctane sulfonamide)propyl]-N,N-dimethyl-N-carboxymethylene ammonium betaine |
| fluoroalkyl($C_{11}$–$C_{20}$)carboxylate |
| perfluoroalkyl carboxylate($C_7$–$C_{13}$) |
| perfluorooctane sulfonic diethanol amide |
| perfluoroalkyl($C_4$–$C_{12}$)sulfonate(Li, K, Na) |
| N-propyl-N-(2-hydroxy ethyl)perfluoroactane sulfonamide |
| perfluoroalkyl($C_6$–$C_{10}$)sulfonamide propyl trimethyl ammonium salt |
| perfluoroalkyl($C_6$–$C_{10}$)-N-ethyl sulfonyl glycine salt (K) |
| bisphosphate(N-perfluorooctyl sulfonyl-N-ethyl amine ethyl |
| monoperfluoroalkyl($C_6$–$C_{16}$)ethyl phosphate |

In the present invention, the separating member of thermally flexible toner or ink can be formed by holding a water-soluble polymer in a state in which water is included in the image supporting member as the chartaceous material. Further, in the image supporting member of cellulose fibers, the water-soluble polymer can come in contact with a thermally flexible toner image inside cellulose fibers unable to come in contact with the separating member of the above separating means. In this case, the water-soluble polymer can come in contact with the cellulose fibers, the thermally flexible toner image and the separating member. The thermally flexible toner image can be separated from the chartaceous material by adhesive force of the separating member without damaging the chartaceous material.

The following Table 8 shows typical water-soluble polymers, but the present invention is not limited to these water-soluble polymers.

TABLE 8

- water-soluble polymer
  - natural polymer
    - starch
      - sweet potato starch
      - potato starch
      - tapioca starch
      - wheat starch
      - corn starch
    - mannan
      - devil's-tongue
    - seaweeds
      - funorin
      - agar (galactan)
      - sodium alginate (harmlessness)
    - plant mucilage
      - hybiscus
      - tragacanth
      - gum arabic
    - microbiological mucilage
      - dextran
      - levan
    - Protein
      - glue
      - gelatin
      - casein
      - collagen
  - semi-synthetic product
    - cellulose
      - viscose
      - methyl cellulose (low toxicity)
      - ethyl cellulose (EC)
      - hydroxy ethyl cellulose (HEC)
      - carboxy methyl cellulose (CMC) (harmlessness)
    - starch
      - soluble starch
      - carboxy methyl starch (CMS)
      - dialdehyde starch
  - synthetic product
    - polyvinyl alcohol (poval)
    - polyacrylic sodium
    - polyethylene oxide
    - isobutylene-maleic anhydride In the present invention, the image supporting member forming a hydrophobic image thereon is impregnated with water. In particular, a suitable image separating means is used to separate the image from the image supporting member in a state in which water is sufficiently included in the image supporting member by using a surfactant, or the separating member of thermally flexible toner or ink is formed. For example, the suitable image separating means is constructed by a rubber roller for heating pressure and fixing, or an adhesive tape such as a pressure sensitive adhesive tape having a pressure sensitive adhesive layer. When such an image separating means is used, the image can be removed from the image supporting member as a paper layer by the separating member of thermally flexible toner or ink without almost removing paper fibers from the image supporting member.

In the present invention, resin for forming the separating member of thermally flexible toner or ink is constructed by toner component resin of the thermally flexible ink or component resin of an adhesive as follows in addition to the above water-soluble polymer.

(1) Toner component resin of thermally flexible ink

For example, the toner component resin of thermally flexible ink is constructed by polystyrene, acrylic resin, methacrylic resin, styrene-bytylacrylic copolymer, styrene-butadiene copolymer, polyester, epoxy :resin, etc.

(2) Component resin of adhesive

For example, the component resin of an adhesive is constructed by protein resins of glue, gelatin, albumin, casein, etc., carbohydrate resins of starch, cellulose, composite polysaccharide such as gum arabic, tragacanth rubber, etc., thermoplastic resins of polymer and copolymer of vinyl acetate, acrylic, ethylene copolymer, polyamide, polyester, polyurethane, etc., resins of polychloroprene, nitrile rubber, regenerated rubber, SBR, natural rubber, etc.

No kinds of resins are limited if these resins have adhesive property with respect to an image. Accordingly, the present invention is not limited to the above resins, but water-soluble or non-water-soluble resin can be also used.

Resin forming the above thermally flexible ink separating member can be formed on a surface of another supporting member forming the separating means such as a roller, a sheet, a tape, etc. Otherwise, the separating means can be formed in the shape of a roller, a sheet, a tape, etc. by using only this resin. This thermally flexible ink separating means may be constructed by an adhesive tape having a pressure sensitive adhesive layer of rubber, acrylic, etc. on a supporting member of each of a cellophane adhesive tape, a Kraft paper tape, a polyvinyl chloride tape, an acetate tape, a filament tape.

Each of the above surfactant and the above water-soluble polymer in the present invention is used as a paper sizing agent, etc. in a paper manufacturing industry. Accordingly, no paper surface is damaged by the surfactant or the water-soluble polymer even when the surfactant or the water-soluble polymer is used. Further, the surfactant improves the paper surface when the surfactant in an aqueous solution preferably has a concentration of 0.01% to 20%. The water-soluble polymer also improves the paper surface when the water-soluble polymer in an aqueous solution preferably has a concentration of 0.1% to 20% and more preferably has a concentration of 0.5% to 10%. When the aqueous solution has an excessively high concentration, a sheet of regenerative paper is hardened and becomes adhesive since this paper sheet absorbs water in the air.

A method for regenerating an image holding-supporting member is executed by using a regenerating apparatus of the image holding-supporting member shown in the sole Figure. However, the present invention is not limited to this regenerating apparatus.

The regenerating apparatus has means coating an image holding-supporting member with at least one kind of separating liquid or aqueous solution including water molecules; the separating liquid or aqueous solution being selected from a group of a liquid including at least water molecules, an aqueous solution including a surfactant, an aqueous solution including a water-soluble polymer, and an aqueous solution including a water-soluble polymer and a surfactant; means for separating a hydrophobic image from a chartaceous material; and means for drying an image supporting member in which the hydrophobic image is separated from the chartaceous material.

As shown in the sole Figure, an image holding-supporting member has a hydrophobic image. Otherwise, an image supporting member can hold a hydrophobic image. The image holding-supporting member or the image supporting member is fed by a paper feed roller 2 from a paper feed tray i onto a guide plate 3 and is then fed to a separating roller 5 by conveying rollers 4 from the guide plate 3. A surface of the separating roller 5 is coated with a separating liquid 7 by a liquid supplying roller 6. Thus, the image supporting member fed from the conveying rollers 4 is coated and impregnated with the separating liquid 7. The image supporting member coated and impregnated with the separating liquid 7 comes in contact with a separated material of toner. This image supporting member is then heated by a heating roller 8 and comes in press contact with the heating roller 8. Thereafter, the separated material is separated from the image supporting member by a separating claw 9. The separated material is removed from the surface of the separating roller 5 by a toner cleaning portion 10. The surface of the separating roller 5 is again coated with the separating liquid 7. The image supporting member separated by the separating claw 9 has no hydrophobic image on its surface. Accordingly, this image supporting member attains a state in which characters, etc. can be again copied and printed on the image supporting member. This image supporting member able to be recopied and reprinted is then guided onto a drying belt 12 by conveying rollers 11a and is dried. The dried image supporting member having no image is discharged onto a paper discharging tray 13 by conveying rollers 11b so that the image supporting member able to be recopied and reprinted can be finally obtained. In the Figure, reference numerals 20 and 22 respectively designate a toner collecting portion and a conveying rib.

Concrete embodiments of the present invention will next be described.

EMBODIMENT 1

A sheet of PPC copying paper unused and having a size A4 is dipped into a starch aqueous solution of a 1% water-soluble polymer and is then dried by a suitable method. Thus, a sheet of copying paper able to be repeatedly used is manufactured.

An image is formed on this dried sheet of copying paper by a PPC copying machine manufactured by e.g., RICHO in Japan as IMAGIO320 FP1. Thereafter, this paper sheet is dipped into an aqueous solution including starch of a 1% water-soluble polymer. Then, a heated rubber roller comes in press contact with a copied image face of the paper sheet. When the sheet of copying paper is then separated from the rubber roller, the image formed on the paper sheet is clearly transferred onto the rubber roller from the paper face. After the paper sheet is fed from the rubber roller, this paper sheet becomes a sheet of plain or solid-color paper having no image thereon. Further, this image is separated From the paper sheet face without almost removing Fibers from the paper sheet. Accordingly, the paper sheet has a face equal to that of a sheet of unused copying paper before a copy is made.

When the image is removed from the sheet of copying paper once copied and the paper sheet is dried and reused in the above copying machine, it is possible to obtain a sheet of copying paper having a clear image thereon. Such an operation is repeatedly performed ten times. However, the quality of a copied image on the paper sheet is equal to that on a sheet of copying paper which is not repeatedly used to make a copy.

EMBODIMENT 2

A sheet of PPC copying paper unused and having a size A4 is dipped into an aqueous solution of carboxymethylcellulose (CMC) of a 2% water-soluble polymer and is then dried by a suitable method. Thus, a sheet of copying paper able to be repeatedly used is manufactured.

An image is formed on this dried sheet of copying paper by a PPC copying machine manufactured by e.g., RICHO in Japan as IMAGIO320 FP1. Thereafter, this paper sheet is dipped into an aqueous solution of 1.5% CMC. The image is then removed from the sheet of copying paper by the same manufacturing method as the Embodiment 1 so that a sheet of plain or solid-color paper having no image is manufactured. This solid-color paper sheet has a face equal to that of a sheet of unused copying paper.

When the image is removed from the sheet of copying paper once copied and the paper sheet is dried and reused in the above copying machine, it is possible to obtain a sheet of copying paper having a clear image thereon. Such an operation is repeatedly performed ten times. However, the quality of a copied image on the paper sheet is equal to that on a sheet of copying paper which is not repeatedly used to make a copy.

EMBODIMENT 3

A sheet of PPC copying paper unused and having a size A4 is dipped into a starch aqueous solution of a 1% water-soluble polymer and is then dried by a suitable method. Thus, a sheet of copying paper able to be repeatedly used is manufactured.

An image is formed on each of front and rear faces of this dried sheet of copying paper by a PPC copying machine manufactured by e.g., RICHO in Japan as IMAGIO320 FP1. Thereafter, this paper sheet is dipped into an aqueous solution including starch of a 1% water-soluble polymer. Then, a heated rubber roller sequentially comes in press contact with the front and rear copied image faces of the paper sheet. When the sheet of copying paper is separated from the rubber roller, the images formed on the front and rear faces of the paper sheet are clearly transferred onto the rubber roller from the paper sheet faces. After the paper sheet is fed from the rubber roller, this paper sheet becomes a sheet of plain or solid-color paper having no image on each of the front and rear faces thereof. Further, this image is separated from each of the front and rear paper sheet faces without almost removing fibers from the paper sheet. Accordingly, the paper sheet has front and rear faces equal to those of a sheet of unused copying paper before a copy is made.

When the images are removed from the sheet of copying paper once copied and the paper sheet is dried and reused in the above copying machine, it is possible to obtain a sheet of copying paper having a clear image on each of front and rear faces thereof. Such an operation is repeatedly performed ten times. However, the quality of a copied image on each of the front and rear faces of the paper sheet is equal to that on each of the front and rear faces of a sheet of copying paper which is not repeatedly used to make a copy.

EMBODIMENT 4

A sheet of PPC copying paper unused and having a size A4 is dipped into an aqueous solution of 1% tonakurin 205 surfactant as a surface active agent manufactured by e.g., NIHON EMULSIFIER in Japan and is then dried by a suitable method. Thus, a sheet of copying paper able to be repeatedly used is manufactured.

An image is formed on this dried sheet of copying paper by a PPC copying machine manufactured by e.g., RICHO in Japan as IMAGIO320 FP1. Thereafter, this paper sheet is dipped into an aqueous solution including starch of a 1% water-soluble polymer. Then, a heated rubber roller comes in press contact with a copied image face of the paper sheet. When the sheet of copying paper is separated from the rubber roller, the image formed on the paper sheet is clearly transferred onto the rubber roller from the paper face. After the paper sheet is fed from the rubber roller, this paper sheet becomes a sheet of plain or solid-color paper having no image thereon. Further, this image is separated from the paper sheet face without almost removing fibers from the paper sheet. Accordingly, the paper sheet has a face equal to that of a sheet of unused copying paper before a copy is made.

When the image is removed from the sheet of copying paper once copied and the paper sheet is dried and reused in the above copying machine, it is possible to obtain a sheet of copying paper having a clear image thereon. Such an operation is repeatedly performed ten times. However, the quality of a copied image on the paper sheet is equal to that on a sheet of copying paper which is not repeatedly used to make a copy.

EMBODIMENT 5

Processing operations in this Embodiment 5 are similar to those in the Embodiment 4 except that a 2% CMC aqueous solution is used instead of the aqueous solution including 1% water-soluble starch in the Embodiment 4. As a result, a face of a sheet of copying paper and the quality of an image thereon are the same as a sheet of copying paper which is not repeatedly used to make a copy.

EMBODIMENT 6

No regenerative processing of a sheet of PPC copying paper is performed in advance in an unused state. An image is then formed on this paper sheet by a PPC copying machine manufactured by e.g., RICHO in Japan as IMAGIO320 FP1 Thereafter, this paper sheet is dipped into water. Then, a heated rubber roller comes in press contact with a copied image face of the paper sheet. When the sheet of copying paper is next separated from the rubber roller, the image formed on the paper sheet is clearly transferred onto the rubber roller from the paper face. After the paper sheet is fed from the rubber roller, this paper sheet becomes a sheet of plain or solid-color paper having no image thereon. This paper sheet is dried so that it is possible to manufacture a sheet of regenerative paper reusable to make a copy.

When the image is removed from the sheet of copying paper once copied and the paper sheet is dried and reused in the above copying machine, it is possible to obtain a sheet of copying paper having a clear image thereon. Such an operation is repeatedly performed ten times. However, the quality of a copied image on the paper sheet is equal to that on a sheet of copying paper which is not repeatedly used to make a copy.

EMBODIMENT 7

Processing operations in this Embodiment 7 are similar to those in the Embodiment 6 except that an aqueous solution of 1% tonakurin 205 surfactant as a surface active agent manufactured by e.g., NIHON EMULSIFIER in Japan is used instead of water. Thus, a sheet of regenerative paper reusable to make a copy is manufactured by the same manufacturing method as the Embodiment 6.

A copying operation, an image removing operation and a drying operation are repeatedly performed ten times by using this sheet of regenerative paper and the same manufacturing method as the Embodiments 1 to 6. However, a face of the sheet of regenerative paper and the quality of a copied image thereon are the same as a sheet of copying paper which is not repeatedly used to make a copy.

EMBODIMENT 8

Processing operations in this Embodiment 8 are similar to those in the Embodiment 6 except that an aqueous solution including 2% starch is used instead of water. Thus, a sheet of regenerative paper reusable to make a copy is manufactured by the same manufacturing method as the Embodiment 6.

A copying operation, an image removing operation and a drying operation are repeatedly performed ten times by using this sheet of regenerative paper and the same manufacturing method as the Embodiments 1 to 6. However, a face of the sheet of regenerative paper and the quality of a copied image thereon are the same as a sheet of copying paper which is not repeatedly used to make a copy.

EMBODIMENT 9

Processing operations in this Embodiment 9 are similar to those in the Embodiment 6 except that an aqueous solution including 2% CMC is used instead of water. Thus, a sheet of regenerative paper reusable to make a copy is manufactured by the same manufacturing method as the Embodiment 6.

A copying operation, an image removing operation and a drying operation are repeatedly performed ten times by using this sheet of regenerative paper and the same manufacturing method as the Embodiments 1 to 6. However, a face of the sheet of regenerative paper and the quality of a copied image thereon are the same as a sheet of copying paper which is not repeatedly used to make a copy.

EMBODIMENT 10

Processing operations in this Embodiment 10 are similar to those in the Embodiment 6 except that an aqueous solution including 1.5% tonakurin 205 surfactant as a surface active agent manufactured by e.g., NIHON EMULSIFIER in Japan and 3% starch of a water-soluble polymer is used instead of water. Thus, a sheet of regenerative paper reusable to make a copy is manufactured by the same manufacturing method as the Embodiment 6.

A copying operation, an image removing operation and a drying operation are repeatedly performed ten times by using this sheet of regenerative paper and the same manufacturing method as the Embodiments 1 to 6. However, a face of the sheet of regenerative paper and the quality of a copied image thereon are the same as a sheet of copying paper which is not repeatedly used to make a copy.

EMBODIMENT 11

Processing operations in this Embodiment 11 are similar to those in the Embodiment 6 except that an aqueous solution including 1.5% tonakurin 205 surfactant as a surface active agent manufactured by e.g., NIHON EMULSIFIER in Japan and 2% CMC of a water-soluble polymer is used instead of water. Thus, a sheet of regenerative paper reusable to make a copy is manufactured by the same manufacturing method as the Embodiment 6.

A copying operation, an image removing operation and a drying operation are repeatedly performed ten times by using this sheet of regenerative paper and the same manufacturing method as the Embodiments 1 to 6. However, a face of the sheet of regenerative paper and the quality of a copied image thereon are the same as a sheet of copying paper which is not repeatedly used to make a copy.

EMBODIMENT 12

An image is formed on a sheet of copying paper by a normal PPC copying machine manufactured by e.g., RICHO in Japan as IMAGIO 320 FP1. Thereafter, this paper sheet is dipped into an aqueous solution including 1% tonakurin 205 surfactant as a surface active agent manufactured by e.g., NIHON EMULSIFIER in Japan. Then, an adhesive face of a cellophane adhesive tape manufactured by e.g., NICHIBAN in Japan comes in press contact with a copied image face of the paper sheet. When the sheet of copying paper is separated from the cellophane adhesive tape, the copied image formed on the paper sheet is clearly transferred onto the adhesive face of the cellophane adhesive tape from the paper face. Thus, this paper sheet becomes a sheet of plain or solid-color paper having no image thereon. When the paper sheet having no image is dried and reused in the above PPC copying machine, a clear copied image can be formed on this sheet of copying paper.

Such an operation is repeatedly performed five times. However, the quality of a copied image on the paper sheet is equal to that on a new sheet of copying paper which is not repeatedly used to make a copy.

EMBODIMENT 13

An image is formed on a sheet of copying paper by a normal PPC copying machine manufactured by e.g., RICHO in Japan as IMAGIO 320 FP1. Then, this paper sheet is dipped into an aqueous solution including 1.5% tonakurin 205 surfactant as a surface active agent manufactured by e.g., NIHON EMULSIFIER in Japan and carboxymethylcellulose (CMC) of a 3% water-soluble polymer. Thereafter, a heated rubber roller comes in press contact with a copied image face of the paper sheet. When the sheet of copying paper is next separated from the robber roller, the image formed on the paper sheet is clearly transferred onto the rubber roller from the paper face. After this sheet of copying paper is fed from the rubber roller, this paper sheet becomes a sheet of plain or solid-color paper having no image thereon. When the paper sheet having no image is dried and reused in the above PPC copying machine, a clear copied image can be formed on this sheet of copying paper.

Such an operation is repeatedly performed five times. However, the quality of a copied image on the paper sheet is equal to that on a new sheet of copying paper which is not repeatedly used to make a copy.

EMBODIMENT 14

An image is formed on a sheet of copying paper by a normal PPC copying machine manufactured by e.g., RICHO in Japan as IMAGIO 320 FP1. Then, this paper sheet is dipped into an aqueous solution including 1.5% tonakurin 205 surfactant as a surface active agent manufactured by e.g., NIHON EMULSIFIER in Japan and carboxymethylcellulose (CMC) of a 3% water-soluble polymer. Thereafter, an adhesive face of a gummed cloth tape comes in press contact with a copied image face of the paper sheet. When the sheet of copying paper is separated from the gummed cloth tape, the image formed on the paper sheet is clearly transferred onto the gummed cloth tape from the paper face. Thus, this paper sheet becomes a sheet of plain or solid-color paper having no image thereon. When the paper sheet having no image is dried and reused in the above PPC copying machine, a clear copied image can be formed on this sheet of copying paper.

Such an operation is repeatedly performed five times. However, the quality of a copied image on the paper sheet is equal to that on a new sheet of copying paper which is not repeatedly used to make a copy.

EMBODIMENT 15

An image is formed on a sheet of copying paper by a normal PPC copying machine manufactured by e.g., RICHO in Japan as IMAGIO 320 FP1. Then, this paper sheet is dipped into an aqueous solution including 1.5% tonakurin 205 surfactant as a surface active agent manufactured by e.g., NIHON EMULSIFIER in Japan and carboxymethylcellulose (CMC) of a 3% water-soluble polymer. Thereafter, a separating member sheet is heated and comes in press contact with a copied image face of the paper sheet. This separating member sheet is constructed by toner component resin of thermally melted or flexible ink having polystyrene, poly-n-butylacrylate and poly-i-butylmethacrylate in a ratio of 10:4:8. When the sheet of copying paper is then separated from the separating member sheet, the image formed on the paper sheet is clearly transferred onto the separating member sheet from the paper face. Thus, this paper sheet becomes a sheet of plain or copying paper having no image thereon. When the paper sheet having no image is dried and reused in the above PPC copying machine, a clear copied image can be formed on this sheet of copying paper.

Such an operation is repeatedly performed five times. However, the quality of a copied image on the paper sheet is equal to that on a new sheet of copying paper which is not repeatedly used to make a copy.

EMBODIMENT 16

Processing operations in this Embodiment 16 are similar to those in the Embodiment 6 except that an aqueous solution of 0.02% BT-7 surfactant as a surface active agent manufactured by e.g., NIKKO CHEMICALS in Japan is used instead of water. Thus, a sheet of regenerative paper reusable to make a copy is manufactured by the same manufacturing method as the Embodiment 6.

A copying operation, an image removing operation and a drying operation are repeatedly performed ten times by using this sheet of regenerative paper and the same manufacturing method as the Embodiments 1 to 6. However, a face of the sheet of regenerative paper and the quality of a copied image thereon are the same as a sheet of copying paper which is not repeatedly used to make a copy.

EMBODIMENT 17

Processing operations in this Embodiment 17 are similar to those in the Embodiment 6 except that an aqueous solution of 0.05% BT-9 surfactant as a surface active agent manufactured by e.g., NIKKO CHEMICALS in Japan is used instead of water. Thus, a sheet of regenerative paper reusable to make a copy is manufactured by the same manufacturing method as the Embodiment 6.

A copying operation, an image removing operation and a drying operation are repeatedly performed ten times by using this sheet of regenerative paper and the same manufacturing method as the Embodiments 1 to 6. However, a face of the sheet of regenerative paper and the quality of a copied image thereon are the same as a sheet of copying paper which is not repeatedly used to make a copy.

EMBODIMENT 18

Processing operations in this Embodiment 18 are similar to those in the Embodiment 6 except that an aqueous solution of 0.2% BT-12 surfactant as a surface active agent manufactured by e.g., NIKKO CHEMICALS in Japan is used instead of water. Thus, a sheet of regenerative paper reusable to make a copy is manufactured by the same manufacturing method as the Embodiment 6.

A copying operation, an image removing operation and a drying operation are repeatedly performed ten times by using this sheet of regenerative paper and the same manufacturing method as the Embodiments 1 to 6. However, a face of the sheet of regenerative paper and the quality of a copied image thereon are the same as a sheet of copying paper which is not repeatedly used to make a copy.

EMBODIMENT 19

Processing operations in this Embodiment 19 are similar to those in the Embodiment 4 except that an aqueous solution of 0.02% BT-7 surfactant as a surface active agent manufactured by e.g., NIKKO CHEMICALS in Japan is used instead of the tonakurin 205 surfactant. Thus, a sheet of copying paper reusable to make a copy is manufactured by the same manufacturing method as the Embodiment 4. An image is formed on this paper sheet and is then separated from this paper sheet.

When the image is removed from the paper sheet once copied and the paper sheet having no image is dried and reused in the above PPC copying machine, a clear copied image can be formed on this sheet of copying paper. Such an operation is repeatedly performed ten times. However, the quality of a copied image on the paper sheet is equal to that on a sheet of copying paper which is not repeatedly used to make a copy.

EMBODIMENT 20

Processing operations in this Embodiment 20 are similar to those in the Embodiment 4 except that an aqueous solution of 0.05% BT-9 surfactant as a surface active agent manufactured by e.g., NIKKO CHEMICALS in Japan is used instead of the tonakurin 205 surfactant. Thus, a sheet of copying paper reusable to make a copy is manufactured by the same manufacturing method as the Embodiment 4. An image is formed on this paper sheet and is then separated from this paper sheet.

When the image is removed from the paper sheet once copied and the paper sheet having no image is dried and reused in the above PPC copying machine, a clear copied image can be formed on this sheet of copying paper. Such an operation is repeatedly performed ten times. However, the quality of a copied image on the paper sheet is equal to that on a sheet of copying paper which is not repeatedly used to make a copy.

EMBODIMENT 21

Processing operations in this Embodiment 21 are similar to those in the Embodiment 4 except that an aqueous solution of 0.2% BT-12 surfactant as a surface active agent manufactured by e.g., NIKKO CHEMICALS in Japan is used instead of the tonakurin 205 surfactant. Thus, a sheet of copying paper reusable to make a copy is manufactured by the same manufacturing method as the Embodiment 4. An image is formed on this paper sheet and is then separated from this paper sheet.

When the image is removed from the paper sheet once copied and the paper sheet having no image is dried and reused in the above PPC copying machine, a clear copied image can be formed on this sheet of copying paper. Such an operation is repeatedly performed ten times. However, the quality of a copied image on the paper sheet is equal to that on a sheet of copying paper which is not repeatedly used to make a copy.

EMBODIMENT 22

Processing operations in this Embodiment 22 are similar to those in the Embodiment 5 except that an aqueous solution of 0.02% BT-7 surfactant as a surface active agent manufactured by e.g., NIKKO CHEMICALS in Japan is used instead of the tonakurin 205 surfactant. Thus, a sheet of copying paper reusable to make a copy is manufactured by the same manufacturing method as the Embodiment 5. An image is formed on this paper sheet and is then separated from this paper sheet.

When the image is removed from the paper sheet once copied and the paper sheet having no image is dried and reused in the above PPC copying machine, a clear copied image can be formed on this sheet of copying paper. Such an operation is repeatedly performed ten times. However, the quality of a copied image on the paper sheet is equal to that on a sheet of copying paper which is not repeatedly used to make a copy.

EMBODIMENT 23

Processing operations in this Embodiment 23 are similar to those in the Embodiment 5 except that an aqueous solution of 0.05% BT-9 surfactant as a surface active agent manufactured by e.g., NIKKO CHEMICALS in Japan is used instead of the tonakurin 205 surfactant. Thus, a sheet of copying paper reusable to make a copy is manufactured by the same manufacturing method as the Embodiment 5. An image is formed on this paper sheet and is then separated from this paper sheet.

When the image is removed from the paper sheet once copied and the paper sheet having no image is dried and reused in the above PPC copying machine, a clear copied image can be formed on this sheet of copying paper. Such an operation is repeatedly performed ten times. However, the quality of a copied image on the paper sheet is equal to that on a sheet of copying paper which is not repeatedly used to make a copy.

EMBODIMENT 24

Processing operations in this Embodiment 24 are similar to those in the Embodiment 5 except that an aqueous solution of 0.2% BT-12 surfactant as a surface active agent manufactured by e.g., NIKKO CHEMICALS in Japan is used instead of the tonakurin 205 surfactant. Thus, a sheet of copying paper reusable to make a copy is manufactured by the same manufacturing method as the Embodiment 5. An image is formed on this paper sheet and is then separated from this paper sheet.

When the image is removed from the paper sheet once copied and the paper sheet having no image is dried and reused in the above PPC copying machine, a clear copied image can be formed on this sheet of copying paper. Such an operation is repeatedly performed ten times. However, the quality of a copied image on the paper sheet is equal to that on a sheet of copying paper which is not repeatedly used to make a copy.

EMBODIMENT 25

Processing operations in this Embodiment 25 are similar to those in the Embodiment 6 except that an aqueous solution including 0.02% BT-7 surfactant as a surface active agent manufactured by e.g., NIKKO CHEMICALS in Japan and 3% starch of a water-soluble polymer is used instead of water. Thus, a sheet of regenerative paper reusable to make a copy is manufactured by the same manufacturing method as the Embodiment 6.

A copying operation, an image removing operation and a drying operation are repeatedly performed ten times by using this sheet of regenerative paper and the same manufacturing method as the Embodiments 1 to 6. However, a face of the sheet of regenerative paper and the quality of a copied image thereon are the same as a sheet of copying paper which is not repeatedly used to make a copy.

EMBODIMENT 26

Processing operations in this Embodiment 26 are similar to those in the Embodiment 6 except that an aqueous solution including 0.05% BT-9 surfactant as a surface active agent manufactured by e.g., NIKKO CHEMICALS in Japan and 2% CMC of a water-soluble polymer is used instead of water. Thus, a sheet of regenerative paper reusable to make a copy is manufactured by the same manufacturing method as the Embodiment 6

A copying operation, an image removing operation and a drying operation are repeatedly performed ten times by using this sheet of regenerative paper and the same manufacturing method as the Embodiments 1 to 6. However, a face of the sheet of regenerative paper and the quality of a copied image thereon are the same as a sheet of copying paper which is not repeatedly used to make a copy.

EMBODIMENT 27

Processing operations in this Embodiment 27 are similar to those in the Embodiment 6 except that an aqueous solution including 0.2% BT-12 surfactant as a surface active agent manufactured by e.g., NIKKO CHEMICALS in Japan and 3% starch of a water-soluble polymer is used instead of water. Thus, a sheet of regenerative paper reusable to make a copy is manufactured by the same manufacturing method as the Embodiment 6.

A copying operation, an image removing operation and a drying operation are repeatedly performed ten times by using this sheet of regenerative paper and the same manufacturing method as the Embodiments 1 to 6. However, a face of the sheet of regenerative paper and the quality of a copied image thereon are the same as a sheet of copying paper which is not repeatedly used to make a copy.

EMBODIMENT 28

Processing operations in this Embodiment 28 are similar to those in the Embodiment 6 except that an aqueous solution including 0.02% BT-7 surfactant as a surface active agent manufactured by e.g., NIKKO. CHEMICALS in Japan and 2% CMC of a water-soluble polymer is used instead of water. Thus, a sheet of regenerative paper reusable to make a copy is manufactured by the same manufacturing method as the Embodiment 6.

A copying operation, an image removing operation and a drying operation are repeatedly performed ten times by using this sheet of regenerative paper and the same manufacturing method as the Embodiments 1 to 6. However, a face of the sheet of regenerative paper and the quality of a copied image thereon are the same as a sheet of copying paper which is not repeatedly used to make a copy.

EMBODIMENT 29

Processing operations in this Embodiment 29 are similar to those in the Embodiment 6 except that an aqueous solution including 0.05% BT-9 surfactant as a surface active agent manufactured by e.g., NIKKO CHEMICALS in Japan and 3% starch of a water-soluble polymer is used instead of water. Thus, a sheet of regenerative paper reusable to make a copy is manufactured by the same manufacturing method as the Embodiment 6.

A copying operation, an image removing operation and a drying operation are repeatedly performed ten times by using this sheet of regenerative paper and the same manufacturing method as the Embodiments 1 to 6. However, a face of the sheet of regenerative paper and the quality of a copied image thereon are the same as a sheet of copying paper which is not repeatedly used to make a copy.

EMBODIMENT 30

Processing operations in this Embodiment 30 are similar to those in the Embodiment 6 except that an aqueous solution including 0.2% BT-12 surfactant as a surface active agent manufactured by e.g., NIKKO CHEMICALS in Japan and 2% CMC of a water-soluble polymer is used instead of water. Thus, a sheet of regenerative paper reusable to make a copy is manufactured by the same manufacturing method as the Embodiment 6.

A copying operation, an image removing operation and a drying operation are repeatedly performed ten times by using this sheet of regenerative paper and the same manufacturing method as the Embodiments 1 to 6. However, a face of the sheet of regenerative paper and the quality of a copied image thereon are the same as a sheet of copying paper which is not repeatedly used to make a copy.

EMBODIMENT 31

An image is formed on a sheet of copying paper by a normal PPC copying machine manufactured by e.g., RICHO in Japan as IMAGIO 320 FP1. Thereafter, this paper sheet is dipped into an aqueous solution including 0.02% BT-7 surfactant as a surface active agent manufactured by e.g., NIKKO CHEMICALS in Japan. Then, an adhesive face of a cellophane adhesive tape manufactured by e.g., NICHIBAN in Japan comes in press contact with a copied image face of the paper sheet. When the sheet of copying paper is separated from the cellophane adhesive tape, the copied image formed on the paper sheet is clearly transferred onto the adhesive face of the cellophane adhesive tape from the paper face. Thus, this paper sheet becomes a sheet of plain or solid-color paper having no image thereon. When the paper sheet having no image is dried and reused in the above PPC copying machine, a clear copied image can be formed on this sheet of copying paper.

Such an operation is repeatedly performed Five times. However, the quality of a copied image on the paper sheet is equal to that on a new sheet of copying paper which is not repeatedly used to make a copy.

EMBODIMENT 32

An image is formed on a sheet of copying paper by a normal PPC copying machine manufactured by e.g., RICHO in Japan as IMAGIO 320 FP1. Then, this paper sheet is dipped into an aqueous solution including 0.02% BT-7 surfactant as a surface active agent manufactured by e.g., NIKKO CHEMICALS in Japan and carboxymethylcellulose (CMC) of a 3% water-soluble polymer. Thereafter, a heated rubber roller comes in press contact with a copied image face of the paper sheet. When the sheet of copying paper is next separated from the robber roller, the image formed on the paper sheet is clearly transferred onto the rubber roller from the paper face. After this sheet of copying paper is fed from the rubber roller, this paper sheet becomes a sheet of plain or solid-color paper having no image thereon. When the paper sheet having no image is dried and reused in the above PPC copying machine, a clear copied image can be formed on this sheet of copying paper.

Such an operation is repeatedly performed five times. However, the quality of a copied image on the paper sheet is equal to that on a new sheet of copying paper which is not repeatedly used to make a copy.

EMBODIMENT 33

An image is formed on a sheet of copying paper by a normal PPC copying machine manufactured by e.g., RICHO. in Japan as IMAGIO 320 FP1. Then, this paper sheet is dipped into an aqueous solution including 0.02% BT-7 surfactant as a surface active agent manufactured by e.g., NIKKO CHEMICALS in Japan and carboxymethylcellulose (CMC) of a 3% water-soluble polymer. Thereafter, an adhesive face of a gummed cloth tape comes in press contact with a copied image face of the paper sheet. When the sheet of copying paper is separated from the gummed cloth tape, the image formed on the paper sheet is clearly transferred onto the gummed cloth tape from the paper face. Thus, this paper sheet becomes a sheet of plain or solid-color paper having no image thereon. When the paper sheet having no image is dried and reused in the above PPC copying machine, a clear copied image can be formed on this sheet of copying paper.

Such an operation is repeatedly performed five times. However, the quality of a copied image on the paper sheet is equal to that on a new sheet of copying paper which is not repeatedly used to make a copy.

EMBODIMENT 34

An image is formed on a sheet of copying paper by a normal PPC copying machine manufactured by e.g., RICHO in Japan as IMAGIO 320 FP1. Then, this paper sheet is dipped into an aqueous solution including 0.02% BT-7 surfactant as a surface active agent manufactured by e.g., NIKKO CHEMICALS in Japan and carboxymethylcellulose (CMC) of a 3% water-soluble polymer. Thereafter, a separating member sheet is heated and comes in press contact with a copied image face of the paper sheet. This separating member sheet is constructed by toner component resin of thermally melted or flexible ink having polystyrene, poly-n-butylacrylate and poly-i-butylmethacrylate in a ratio of 10:4:8. When the sheet of copying paper is then separated from the separating member sheet, the image formed on the paper sheet is clearly transferred onto the separating member sheet from the paper face. Thus, this paper sheet becomes a sheet of plain or copying paper having no image thereon. When the paper sheet having no image is dried and reused in the above PPC copying machine, a clear copied image can be formed on this sheet of copying paper.

Such an operation is repeatedly performed five times. However, the quality of a copied image on the paper sheet is equal to that on a new sheet of copying paper which is not repeatedly used to make a copy.

EMBODIMENT 35

An image is formed on a sheet of copying paper by a normal PPC copying machine manufactured by e.g., RICHO in Japan as IMAGIO 320 FP1. Thereafter, this paper sheet is dipped into an aqueous solution including 0.05% BT-9 surfactant as a surface active agent manufactured by e.g., NIKKO CHEMICALS in Japan. Then, an adhesive face of a cellophane adhesive tape manufactured by e.g., NICHIBAN in Japan comes in press contact with a copied image face of the paper sheet. When the sheet of copying paper is separated from the cellophane adhesive tape, the copied image formed on the paper sheet is clearly transferred onto the adhesive face of the cellophane adhesive tape from the paper face. Thus, this paper sheet becomes a sheet of plain or solid-color paper having no image thereon. When the paper sheet having no image is dried and reused in the above PPC copying machine, a clear copied image can be formed on this sheet of copying paper.

Such an operation is repeatedly performed five times. However, the quality of a copied image on the paper sheet is equal to that on a new sheet of copying paper which is not repeatedly used to make a copy.

EMBODIMENT 36

An image is formed on a sheet of copying paper by a normal PPC copying machine manufactured by e.g., RICHO in Japan as IMAGIO 320 FP1. Then, this paper sheet is dipped into an aqueous solution including 0.05% BT-9 surfactant as a surface active agent manufactured by e.g., NIKKO CHEMICALS in Japan and carboxymethylcellulose (CMC) of a 3% water-soluble polymer. Thereafter, a heated rubber roller comes in press contact with a copied image face of the paper sheet. When the sheet of copying paper is next separated from the robber roller, the image formed on the paper sheet is clearly transferred onto the rubber roller from the paper Face. After this sheet of copying paper is fed from the rubber roller, this paper sheet becomes a sheet of plain or solid-color paper having no image thereon. When the paper sheet having no image is dried and reused in the above PPC copying machine, a clear copied image can be formed on this sheet of copying paper.

Such an operation is repeatedly performed five times. However, the quality of a copied image on the paper sheet is equal to that on a new sheet of copying paper which is not repeatedly used to make a copy.

EMBODIMENT 37

An image is formed on a sheet of copying paper by a normal PPC copying machine manufactured by e.g., RICHO in Japan as IMAGIO 320 FP1. Then, this paper sheet is dipped into an aqueous solution including 0.05% BT-9 surfactant as a surface active agent manufactured by e.g., NIKKO CHEMICALS in Japan and carboxymethylcellulose (CMC) of a 3% water-soluble polymer. Thereafter, an adhesive face of a gummed cloth tape comes in press contact with a copied image face of the paper sheet. When the sheet of copying paper is separated from the gummed cloth tape, the image formed on the paper sheet is clearly transferred onto the gummed cloth tape from the paper face. Thus, this paper sheet becomes a sheet of plain or solid-color paper having no image thereon. When the paper sheet having no image is dried and reused in the above PPC copying machine, a clear copied image can be formed on this sheet of copying paper.

Such an operation is repeatedly performed five times. However, the quality of a copied image on the paper sheet is equal to that on a new sheet of copying paper which is not repeatedly used to make a copy.

EMBODIMENT 38

An image is formed on a sheet of copying paper by a normal PPC copying machine manufactured by e.g., RICHO in Japan as IMAGIO 320 FP1. Then, this paper sheet is dipped into an aqueous solution including 0.05% BT-9 surfactant as a surface active agent manufactured by e.g., NIKKO CHEMICALS in Japan and carboxymethylcellulose (CMC) of a 3% water-soluble polymer. Thereafter, a separating member sheet is heated and comes in press contact with a copied image face of the paper sheet. This separating member sheet is constructed by toner component resin of thermally melted or flexible ink having polystyrene, poly-n-butylacrylate and poly-i-butylmethacrylate in a ratio of 10:4:8. When the sheet of copying paper is then separated from the separating member sheet, the image formed on the paper sheet is clearly transferred onto the separating member sheet from the paper face. Thus, this paper sheet becomes a sheet of plain or copying paper having no image thereon. When the paper sheet having no image is dried and reused in the above PPC copying machine, a clear copied image can be formed on this sheet of copying paper.

Such an operation is repeatedly performed five times. However, the quality of a copied image on the paper sheet is equal to that on a new sheet of copying paper which is not repeatedly used to make a copy.

EMBODIMENT 39

An image is formed on a sheet of copying paper by a normal PPC copying machine manufactured by e.g., RICHO in Japan as IMAGIO 320 FP1. Thereafter, this paper sheet is dipped into an aqueous solution including 0.2% BT-12 surfactant as a surface active agent manufactured by e.g., NIKKO CHEMICALS in Japan. Then, an adhesive face of a cellophane adhesive tape manufactured by e.g. , NICHIBAN in Japan comes in press contact with a copied image face of the paper sheet. When the sheet of copying paper is separated from the cellophane adhesive tape, the copied image formed on the paper sheet is clearly transferred onto the adhesive face of the cellophane adhesive tape from the paper face. Thus, this paper sheet becomes a sheet of plain or solid-color paper having no image thereon. When the paper sheet having no image is dried and reused in the above PPC copying machine, a clear copied image can be formed on this sheet of copying paper.

Such an operation is repeatedly performed five times. However, the quality of a copied image on the paper sheet is equal to that on a new sheet of copying paper which is not repeatedly used to make a copy.

EMBODIMENT 40

An image is formed on a sheet of copying paper by a normal PPC copying machine manufactured by e.g., RICHO in Japan as IMAGIO 320 FP1. Then, this paper sheet is dipped into an aqueous solution including 0.2% BT-12 surfactant as a surface active agent manufactured by e.g., NIKKO CHEMICALS in Japan and carboxymethylcellulose (CMC) of a 3% water-soluble polymer. Thereafter, a heated rubber roller comes in press contact with a copied image face of the paper sheet. When the sheet of copying paper is next separated from the robber roller, the image formed on the paper sheet is clearly transferred onto the rubber roller from the paper face. After this sheet of copying paper is fed from the rubber roller, this paper sheet becomes a sheet of plain or solid-color paper having no image thereon. When the paper sheet having no image is dried and reused in the above PPC copying machine, a clear copied image can be formed on this sheet of copying paper.

Such an operation is repeatedly performed five times. However, the quality of a copied image on the paper sheet is equal to that on a new sheet of copying paper which is not repeatedly used to make a copy.

EMBODIMENT 41

An image is formed on a sheet of copying paper by a normal PPC copying machine manufactured by e.g., RICHO in Japan as IMAGIO 320 FP1. Then, this paper sheet is dipped into an aqueous solution including 0.2% BT-12 surfactant as a surface active agent manufactured by e.g., NIKKO CHEMICALS in Japan and carboxymethylcellulose (CMC) of a 3% water-soluble polymer. Thereafter, an adhesive face of a gummed cloth tape comes in press contact with a copied image face of the paper sheet. When the sheet of copying paper is separated from the gummed cloth tape, the image formed on the paper sheet is clearly transferred onto the gummed cloth tape from the paper face. Thus, this paper sheet becomes a sheet of plain or solid-color paper having no image thereon. When the paper sheet having no image is dried and reused in the above PPC copying machine, a clear copied image can be formed on this sheet of copying paper.

Such an operation is repeatedly performed five times. However, the quality of a copied image on the paper sheet is equal to that on a new sheet of copying paper which is not repeatedly used to make a copy.

EMBODIMENT 42

An image is formed on a sheet of copying paper by a normal PPC copying machine manufactured by e.g., RICHO in Japan as IMAGIO 320 FP1. Then, this paper sheet is dipped into an aqueous solution including 0.2% BT-12 surfactant as a surface active agent manufactured by e.g., NIKKO CHEMICALS in Japan and carboxymethylcellulose (CMC) of a 3% water-soluble polymer. Thereafter, a separating member sheet is heated and comes in press contact with a copied image face of the paper sheet. This separating member sheet is constructed by toner component resin of thermally melted or flexible ink having polystyrene, poly-n-butylacrylate and poly-i-butylmethacrylate in a ratio of 10:4:8. When the sheet of copying paper is then separated from the separating member sheet, the image formed on the paper sheet is clearly transferred onto the separating member sheet from the paper face. Thus, this paper sheet becomes a sheet of plain or copying paper having no image thereon. When the paper sheet having no image is dried and reused in the above PPC copying machine, a clear copied image can be formed on this sheet of copying paper.

Such an operation is repeatedly performed five times. However, the quality of a copied image on the paper sheet is equal to that on a new sheet of copying paper which is not repeatedly used to make a copy.

In the present invention, each of a copied hydrophobic image and a printed hydrophobic image is formed on an image holding-supporting member such as a sheet of paper. At least one portion of this image holding-supporting member is constructed by a chartaceous material having cellulose as a principal component. Each of these images can be sufficiently removed from the image holding-supporting member without damaging a paper layer. The image holding-supporting member removing each of the images therefrom constitutes an image supporting member. Accordingly, the image holding-supporting member such as a sheet of paper can be repeatedly used without throwing away the sheet of paper once used so that a consuming amount of paper can be reduced.

Further, as mentioned above, each of the above surfactant and the above water-soluble polymer in the present invention is used as a paper sizing agent, etc. in a paper manufacturing industry. Accordingly, no paper surface is damaged by the surfactant or the water-soluble polymer even when the surfactant or the water-soluble polymer is used. Furthermore, the surfactant improves the paper surface when the surfactant in an aqueous solution preferably has a concentration of 0.01% to 20%. The water-soluble polymer also improves the paper surface when the water-soluble polymer in an aqueous solution preferably has a concentration of 0.1% to 20% and more preferably has a concentration of 0.5% to 10%.

Many widely different embodiments of the present invention may be constructed without departing from the spirit and scope of the present invention. It should be understood that the present invention is not limited to the specific embodiments described in the specification, except as defined in the appended claims.

What is claimed is:

1. A method of recycling a support material for supporting images thereon, comprising the steps of:

impregnating an image-bearing support material with a liquid comprising water, at least a part of said image-bearing support material comprising a charteceous material with cellulose fibers as a main component and having hydrophobic images formed on the charteceous material;

bringing an image separating member in contact with said hydrophobic images while heating said hydrophobic images;

adhering said hydrophobic images to said image separating member; and separating said hydrophobic images from the charteceous material while impregnated with said liquid by transferring said hydrophobic images onto said image separating member.

2. A method according to claim 1, wherein said liquid comprising water is water or an aqueous solution containing one of the group of a surfactant, a water-soluble polymer, and a combination of a water-soluble polymer and a surfactant.

3. A method according to claim 2, wherein said liquid comprises an aqueous solution having a concentration of surfactant in the range of 0.01% to 20%.

4. A method according to claim 2, wherein said liquid comprises an aqueous solution having a concentration of water-soluble polymer in the range of 0.1% to 20%.

5. A method according to claim 1, wherein said support material is paper comprised mainly of cellulose fibers.

6. A method according to claim 5, wherein said hydrophobic images are formed by thermally flexible ink or toner.

7. A method according to claim 6, wherein said image separating member is constructed of an organic high molecular material, a metallic material, or a ceramic material.

8. A method according to claim 7, wherein said image separating member is constructed of an organic high molecular material made of a water-soluble polymer, a toner component resin of thermally flexible ink, or a component resin of an adhesive.

9. A method according to claim 5, wherein said image separating member is constructed of an organic high molecular material, a metallic material, or a ceramic material.

10. A method according to claim 9, wherein said image separating member is constructed of an organic high molecular material made of a water-soluble polymer, a toner component resin of thermally flexible ink, or a component resin of an adhesive.

11. A method according to claim 5, wherein said support material for supporting images thereon is a support material previously impregnated with an aqueous solution containing at least one of the group of a surfactant, a water-soluble polymer, and a combination of a water-soluble polymer and a surfactant, and dried thereafter.

12. A method according to claim 11, wherein said aqueous solution contains a surfactant and a concentration of the surfactant in the aqueous solution is in the range of 0.01% to 20%.

13. A method according to claim 11, wherein said aqueous solution contains a water-soluble polymer and a concentration of the water-soluble polymer in the aqueous solution is in the range of 0.1% to 20%.

14. A method according to claim 1, wherein said hydrophobic images are formed by thermally flexible ink or toner.

15. A method according to claim 14, wherein said image separating member is constructed of an organic high molecular material, a metallic material, or a ceramic material.

16. A method according to claim 15, wherein said image separating member is constructed of an organic high molecular material made of a water-soluble polymer, a toner component resin of thermally flexible ink, or a component resin of an adhesive.

17. A method according to claim 1, wherein said image separating member is constructed of an organic high molecular material, a metallic material, or a ceramic material.

18. A method according to claim 17, wherein said image separating member is constructed of an organic high molecular material made of a water-soluble polymer, a toner component resin of thermally flexible ink, or a component resin of an adhesive.

19. A method according to claim 1, wherein said support material for supporting images thereon is a support material previously impregnated with an aqueous solution containing at least one of the group of a surfactant, a water-soluble polymer, and a combination of a water-soluble polymer and a surfactant, and dried thereafter.

20. A method according to claim 19, wherein said aqueous solution contains a surfactant and a concentration of the surfactant in the aqueous solution is in the range of 0.01% to 20%.

21. A method according to claim 19, wherein said aqueous solution contains a water-soluble polymer and a concentration of the water-soluble polymer in the aqueous solution is in the range of 0.1% to 20%.

* * * * *